US010443313B2

(12) United States Patent
Cook, III et al.

(10) Patent No.: US 10,443,313 B2
(45) Date of Patent: Oct. 15, 2019

(54) LOCALIZED BINDER FORMATION IN A DRILLING TOOL

(71) Applicant: Halliburton Energy Services, Inc., Houston, TX (US)

(72) Inventors: Grant O. Cook, III, Spring, TX (US); Daniel B. Voglewede, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 252 days.

(21) Appl. No.: 15/547,829

(22) PCT Filed: Mar. 5, 2015

(86) PCT No.: PCT/US2015/018974
§ 371 (c)(1),
(2) Date: Aug. 1, 2017

(87) PCT Pub. No.: WO2016/140677
PCT Pub. Date: Sep. 9, 2016

(65) Prior Publication Data

US 2018/0010393 A1 Jan. 11, 2018

(51) Int. Cl.
*E21B 10/55* (2006.01)
*E21B 10/43* (2006.01)
*B22D 19/14* (2006.01)

(52) U.S. Cl.
CPC ..... *E21B 10/55* (2013.01); *B22D 19/14* (2013.01); *E21B 10/43* (2013.01)

(58) Field of Classification Search
CPC ..... E21B 10/55; B22D 19/14
See application file for complete search history.

(56) References Cited

U.S. PATENT DOCUMENTS 3,551,991 A 1/1971 Reich et al.
4,884,477 A * 12/1989 Smith ..... B22F 7/06 76/108.2

(Continued)

FOREIGN PATENT DOCUMENTS

CA 2664212 4/2008
CN 1904306 1/2007

(Continued)

OTHER PUBLICATIONS

International Preliminary Report on Patentability for PCT Patent Application No. PCT/US2015/018974, dated Sep. 14, 2017; 10 pages.

(Continued)

*Primary Examiner* — Shane Bomar
(74) *Attorney, Agent, or Firm* — Baker Botts L.L.P.

(57) ABSTRACT

A method for forming localized binder in a drilling tool is disclosed. A method includes placing a reinforcement material in a matrix bit body mold, placing a localized binder material within the reinforcement material at a selected location in the matrix bit body mold, wherein the localized binder material confers a selected physical property at the selected location, placing a universal binder material in the matrix bit body mold on top of the reinforcement material, heating the matrix bit body mold, the reinforcement material, the localized binder material, and the universal binder material to a temperature above the melting point of the universal binder material, infiltrating the reinforcement material and the localized binder material with the universal binder material, and cooling the matrix bit body mold, the reinforcement material, the localized binder material, and the universal binder material to form a matrix drill bit body.

20 Claims, 8 Drawing Sheets

(56) References Cited

U.S. PATENT DOCUMENTS

| | | | | |
|---|---|---|---|---|
| 5,541,006 | A | 7/1996 | Conley | |
| 5,641,921 | A | 6/1997 | Dennis et al. | |
| 5,679,445 | A | 10/1997 | Massa et al. | |
| 6,183,687 | B1 | 2/2001 | Greenfield | |
| 6,209,420 | B1 * | 4/2001 | Butcher | B22F 3/1055 76/108.2 |
| 8,517,125 | B2 | 8/2013 | Lockwood | |
| 9,987,675 | B2 | 6/2018 | Thomas | |
| 2004/0244540 | A1 | 12/2004 | Oldham et al. | |
| 2005/0123433 | A1 | 6/2005 | Li et al. | |
| 2006/0185255 | A1 | 8/2006 | Nevoret et al. | |
| 2006/0211340 | A1 | 9/2006 | Thysell | |
| 2008/0073126 | A1 | 3/2008 | Shen et al. | |
| 2008/0164070 | A1 | 7/2008 | Keshavan et al. | |
| 2008/0210473 | A1 | 9/2008 | Zhang et al. | |
| 2008/0282618 | A1 * | 11/2008 | Lockwood | B24D 18/0027 51/295 |
| 2010/0155148 | A1 | 6/2010 | Choc et al. | |
| 2010/0206639 | A1 | 8/2010 | Lockwood | |
| 2010/0236688 | A1 | 9/2010 | Scalzo et al. | |
| 2010/0278604 | A1 | 11/2010 | Glass et al. | |
| 2010/0320005 | A1 | 12/2010 | Burhan et al. | |
| 2011/0024670 | A1 | 2/2011 | Otsuki et al. | |
| 2011/0031032 | A1 | 2/2011 | Mourik et al. | |
| 2011/0031033 | A1 | 2/2011 | Mourik et al. | |
| 2011/0107586 | A1 | 5/2011 | Choe et al. | |
| 2011/0114394 | A1 * | 5/2011 | Lockwood | B22D 19/14 175/428 |
| 2011/0139514 | A1 | 6/2011 | Voronin et al. | |
| 2011/0308864 | A1 | 12/2011 | Lockwood et al. | |
| 2012/0005966 | A1 | 1/2012 | Cleboski et al. | |
| 2012/0067652 | A1 | 3/2012 | Bellin | |
| 2012/0255793 | A1 | 10/2012 | Sheng et al. | |
| 2013/0000982 | A1 | 1/2013 | Olsen | |
| 2013/0180786 | A1 * | 7/2013 | Thomas | E21B 17/1085 175/434 |
| 2013/0247475 | A1 | 9/2013 | Lind et al. | |
| 2014/0069725 | A1 | 3/2014 | Yu et al. | |
| 2016/0281438 | A1 * | 9/2016 | Olsen | E21B 10/42 |
| 2017/0107764 | A1 * | 4/2017 | Cook, III | B22F 7/062 |
| 2018/0142521 | A1 * | 5/2018 | Voglewede | E21B 10/42 |

FOREIGN PATENT DOCUMENTS

| | | |
|---|---|---|
| CN | 101016826 | 8/2007 |
| CN | 101535516 | 9/2009 |
| CN | 103266249 | 8/2013 |
| CN | 104321501 | 1/2015 |

OTHER PUBLICATIONS

Office Action for Canadian Patent Application No. 2973467, dated May 8, 2018; 3 pages.

Office Action for Chinese Patent Application No. 201580072255.1, dated Sep. 14, 2018; 14 pages.

International Search Report and Written Opinion for PCT Patent Application No. PCT/US2015/018974, dated Nov. 17, 2015; 14 pages.

* cited by examiner

LOCALIZED BINDER FORMATION IN A DRILLING TOOL

RELATED APPLICATIONS

This application is a U.S. National Stage Application of International Application No. PCT/US2015/018974 filed Mar. 5, 2015, which designates the United States, and which is incorporated herein by reference in its entirety.

TECHNICAL FIELD

The present disclosure relates generally to drilling tools, such as earth-boring drill bits.

BACKGROUND

Various types of drilling tools including, but not limited to, rotary drill bits, reamers, core bits, under reamers, hole openers, stabilizers, and other downhole tools are used to form wellbores in downhole formations. Examples of rotary drill bits include, but are not limited to, fixed-cutter drill bits, drag bits, polycrystalline diamond compact (PDC) drill bits, matrix drill bits, and hybrid bits associated with forming oil and gas wells extending through one or more downhole formations.

Matrix drill bits are typically formed by placing loose reinforcement material, typically in powder form, into a mold and infiltrating the reinforcement material with a binder material such as a copper alloy. The reinforcement material infiltrated with a molten metal alloy or binder material may form a matrix bit body after solidification of the binder material with the reinforcement material. Hybrid bits containing matrix drill bit features may be formed in a similar manner.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION

During a subterranean operation, various downhole tools, including drill bits, coring bits, reamers, and/or hole enlargers, may be lowered in a wellbore and may be formed of a metal-matrix composite (MMC). According to various system and methods disclosed herein, the materials used to form the MMC may include localized binder material, incorporated during manufacturing, which may be configured to provide localized properties in selected regions of the downhole tool such that the properties of the selected regions are optimized for the conditions experienced by the selected regions during the subterranean operation. The localized binder material may be selected to provide localized properties based on the detrimental conditions that exist in the region of the downhole tool and/or the function of the region of the downhole tool during a subterranean operation. Thus, the use of the localized binder material may improve the performance of the drilling tool. For example, a region of the downhole tool subject to high stresses may be more ductile such that the region has crack-arresting properties while a region of the downhole tool subject to erosion may be less ductile such that the region has erosion-resisting properties. Additionally, in regions of the downhole tool that are less subject to stresses, erosion, and/or other detrimental conditions and do not need the strength provided by a reinforcement material, localized binder material may be used to replace a more expensive reinforcement material and thus reduce the cost of the drilling tool. The present disclosure and its advantages are best understood by referring to FIGS. 1 through 8, where like numbers are used to indicate like and corresponding parts.

Figure 1:
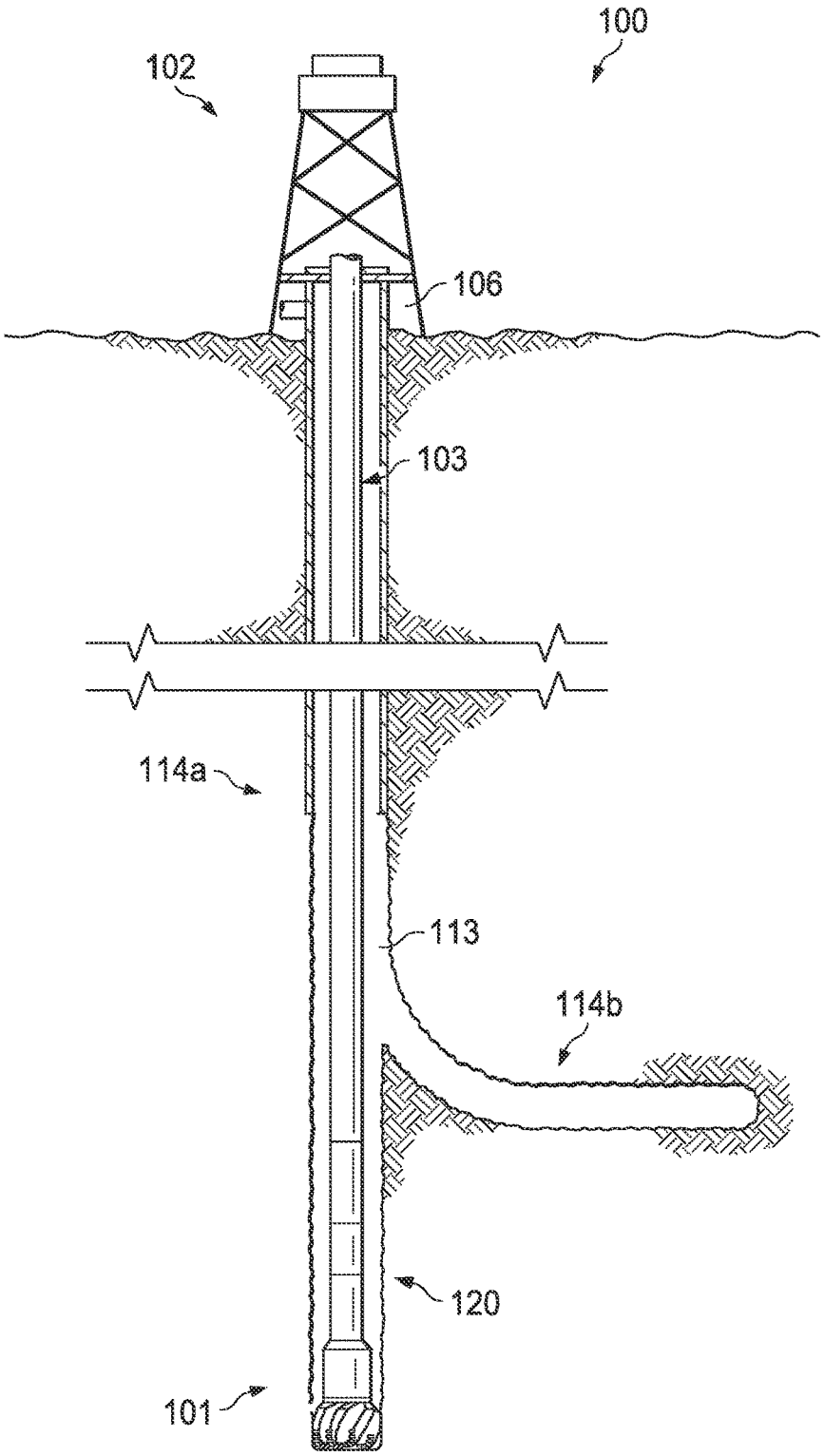
FIG. 1 is an elevation view of a drilling system.

FIG. 1 is an elevation view of a drilling system. Drilling system 100 may include a well surface or well site 106. Various types of drilling equipment such as a rotary table, drilling fluid pumps and drilling fluid tanks (not expressly shown) may be located at well surface or well site 106. For example, well site 106 may include drilling rig 102 that may have various characteristics and features associated with a land drilling rig. However, downhole drilling tools incorporating teachings of the present disclosure may be satisfactorily used with drilling equipment located on offshore platforms, drill ships, semi-submersibles, and/or drilling barges (not expressly shown).

Drilling system 100 may include drill string 103 associated with drill bit 101 that may be used to form a wide variety of wellbores or bore holes such as generally vertical wellbore 114*a* or generally horizontal wellbore 114*b* or any combination thereof. Various directional drilling techniques and associated components of bottom hole assembly (BHA) 120 of drill string 103 may be used to form horizontal wellbore 114*b*. For example, lateral forces may be applied to BHA 120 proximate kickoff location 113 to form generally horizontal wellbore 114*b* extending from generally vertical wellbore 114*a*. The term directional drilling may be used to describe drilling a wellbore or portions of a wellbore that extend at a desired angle or angles relative to vertical. Such angles may be greater than normal variations associated with vertical wellbores. Direction drilling may include horizontal drilling.

Drilling system 100 may also include rotary drill bit (drill bit) 101. Drill bit 101, discussed in further detail in FIG. 2, may be an MMC drill bit which may be formed by placing loose reinforcement material including tungsten carbide powder, into a mold and infiltrating the reinforcement material with a universal binder material including a copper alloy and/or an aluminum alloy. The mold may be formed by milling a block of material, such as graphite, to define a mold cavity having features that correspond generally with the exterior features of drill bit 101.

Drill bit 101 may include one or more blades 126 that may be disposed outwardly from exterior portions of rotary bit body 124 of drill bit 101. Rotary bit body 124 may be generally cylindrical and blades 126 may be any suitable type of projections extending outwardly from rotary bit body 124. Drill bit 101 may rotate with respect to bit rotational axis 104 in a direction defined by directional arrow 105. Blades 126 may include one or more cutting elements 128 disposed outwardly from exterior portions of each blade 126. Blades 126 may further include one or more gage pads (not expressly shown) disposed on blades 126. Drill bit 101 may be designed and formed in accordance with teachings of the present disclosure and may have many different designs, configurations, and/or dimensions according to the particular application of drill bit 101.

In some embodiments, during the mold loading process, a localized binder material may be placed within a reinforcement material in selected locations of the mold to provide localized properties for drill bit 101. The localized properties may optimize the selected locations of drill bit 101 for the conditions experienced by the selected regions during the subterranean operation. The localized binder material may be the same as or different from the universal binder material. The localized binder material may be placed in a variety of configurations based on the selected localized properties for the regions of drill bit 101 in which the localized binder material is placed, as described in more detail with reference to FIGS. 2-8. The reinforcement material and the localized binder material may be infiltrated with a molten universal binder material to form bit body 124 after solidification of the universal binder material and the localized binder material.

Figure 2:
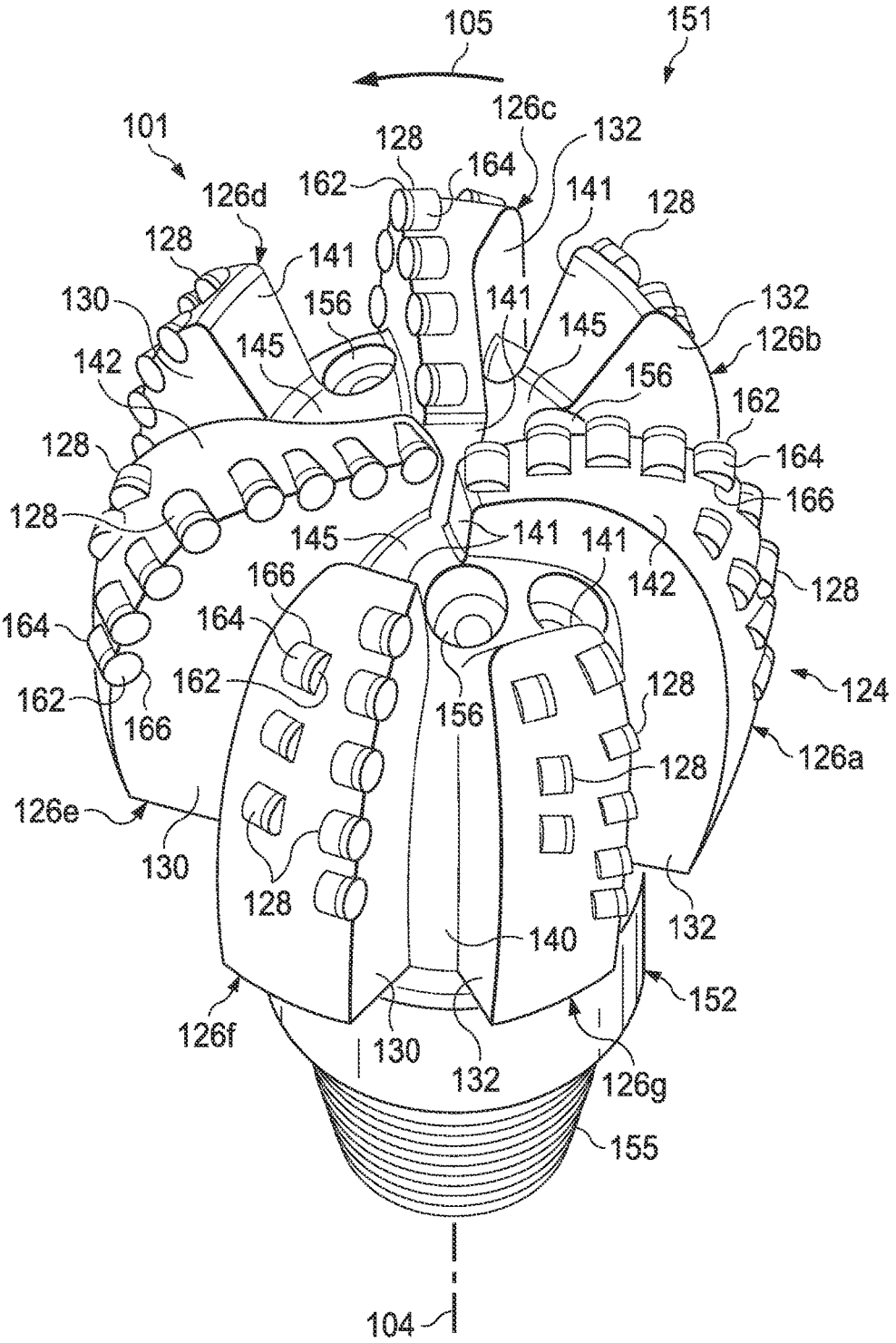
FIG. 2 is an isometric view of a rotary drill bit oriented upwardly in a manner often used to model or design fixed-cutter drill bits.

FIG. 2 is an isometric view of a rotary drill bit oriented upwardly in a manner often used to model or design fixed cutter drill bits. To the extent that at least a portion of the drill bit is formed of an MMC, the drill bit may be any of various types of fixed-cutter drill bits, including PDC bits, drag bits, matrix-body drill bits, steel-body drill bits, hybrid drill bits, and/or combination drill bits including fixed cutters and roller cone bits operable to form wellbore 114 (as illustrated in FIG. 1) extending through one or more downhole formations. Drill bit 101 may be designed and formed in accordance with teachings of the present disclosure and may have many different designs, configurations, and/or dimensions according to the particular application of drill bit 101.

During a subterranean operation, different regions of drill bit 101 may be exposed to different forces and/or stresses. Therefore, during manufacturing of drill bit 101, the properties of drill bit 101 may be customized such that some regions of drill bit 101 may have different properties from other regions of drill bit 101. The localized properties may be achieved by placing a selected type of localized binder material in selected locations and in selected configurations in a mold for drill bit 101. The type, location, and/or configuration of the localized binder material may be selected to provide localized properties for drill bit 101 based on the downhole conditions experienced by the region of drill bit 101 and/or the function of the region of drill bit 101.

Drill bit 101 may be an MMC drill bit which may be formed by placing loose reinforcement material, including tungsten carbide powder, into a mold and infiltrating the reinforcement material with a universal binder material, including a copper alloy and/or an aluminum alloy. The mold may be formed by milling a block of material, such as graphite, to define a mold cavity having features that correspond generally with the exterior features of drill bit 101. Various features of drill bit 101 including blades 126, cutter pockets 166, and/or fluid flow passageways may be provided by shaping the mold cavity and/or by positioning temporary displacement materials within interior portions of the mold cavity. A preformed steel shank or bit mandrel (sometimes referred to as a blank) may be placed within the mold cavity to provide reinforcement for bit body 124 and to allow attachment of drill bit 101 with a drill string and/or BHA. A quantity of reinforcement material may be placed within the mold cavity and infiltrated with a molten universal binder material to form bit body 124 after solidification of the universal binder material with the reinforcement material.

During the mold loading process, a localized binder material may be placed in selected locations of the mold to provide localized properties for drill bit 101. The localized binder material may be the same as or different from the universal binder material and may be placed in a variety of configurations based on the selected localized properties for the regions of drill bit 101 in which the localized binder material is placed, as described in more detail with reference to FIGS. 4-8.

Drill bit 101 may include shank 152 with drill pipe threads 155 formed thereon. Threads 155 may be used to releasably engage drill bit 101 with a bottom hole assembly (BHA), such as BHA 120, shown in FIG. 1, whereby drill bit 101 may be rotated relative to bit rotational axis 104. Plurality of blades **126*a*-126*g* may have respective junk slots or fluid flow paths 140 disposed therebetween. Due to erosion during a subterranean operation, drill bit 101 may be formed with a localized binder material placed near junk slots 140 to provide erosion resistance. The localized binder material may be selected to reduce the surface energy in junk slots 140 to provide optimized fluid flow through junk slots 140**.

Drilling fluids may be communicated to one or more nozzles 156. The regions of drill bit 101 near nozzle 156 may be subject to stresses during the subterranean operation that may cause cracks in drill bit 101. A localized binder material may be added near nozzles 156 to increase the ductility and provide crack-arresting properties near nozzles 156 of drill bit 101. The localized binder material may be selected to reduce the surface energy near nozzles 156 to provide optimized flow of drilling fluids through nozzles 156.

Drill bit 101 may include one or more blades **126*a*-126*g*, collectively referred to as blades 126, that may be disposed outwardly from exterior portions of rotary bit body 124. Rotary bit body 124 may have a generally cylindrical body and blades 126 may be any suitable type of projections extending outwardly from rotary bit body 124. For example, a portion of blade 126 may be directly or indirectly coupled to an exterior portion of bit body 124, while another portion of blade 126 may be projected away from the exterior portion of bit body 124. Blades 126** formed in accordance with the teachings of the present disclosure may have a wide variety of configurations including, but not limited to, substantially arched, helical, spiraling, tapered, converging, diverging, symmetrical, and/or asymmetrical.

Each of blades 126 may include a first end disposed proximate or toward bit rotational axis 104 and a second end disposed proximate or toward exterior portions of drill bit 101 (i.e., disposed generally away from bit rotational axis 104 and toward uphole portions of drill bit 101). Blades 126 may have apex 142 that may correspond to the portion of blade 126 furthest from bit body 124 and blades 126 may join bit body 124 at landing 145. Apex 142 and landing 145 may be subjected to stresses during a subterranean operation that may cause cracks in apex 142 and landing 145. Therefore, a localized binder material may be added near apex 142 and landing 145 to increase the ductility and provide crack-arresting properties at apex 142 and landing 145.

In some cases, blades 126 may have substantially arched configurations, generally helical configurations, spiral shaped configurations, or any other configuration satisfactory for use with each drilling tool. One or more blades 126 may have a substantially arched configuration extending from proximate rotational axis 104 of drill bit 101. The arched configuration may be defined in part by a generally concave, recessed shaped portion extending from proximate bit rotational axis 104. The arched configuration may also be defined in part by a generally convex, outwardly curved portion disposed between the concave, recessed portion and exterior portions of each blade which correspond generally with the outside diameter of the rotary drill bit. The outer surface of blades 126 may be subjected to high stresses during a subterranean operation which may cause cracks to form along the outer surface of blades 126. A localized binder material may be added near the outer surface of blades 126 to increase the ductility and provide crack arresting properties at the outer surface of blades 126.

Blades 126 may have a general arcuate configuration extending radially from rotational axis 104. The arcuate configurations of blades 126 may cooperate with each other to define, in part, a generally cone shaped or recessed portion disposed adjacent to and extending radially outward from the bit rotational axis. Exterior portions of blades 126, cutting elements 128 and other suitable elements may be described as forming portions of the bit face.

Blades 126*a*-126*g* may include primary blades disposed about bit rotational axis 104. For example, in FIG. 2, blades 126*a*, 126*c*, and 126*e* may be primary blades or major blades because respective first ends 141 of each of blades 126*a*, 126*c*, and 126*e* may be disposed closely adjacent to associated bit rotational axis 104. In some configurations, blades 126*a*-126*g* may also include at least one secondary blade disposed between the primary blades. Blades 126*b*, 126*d*, 126*f*, and 126*g* shown in FIG. 2 on drill bit 101 may be secondary blades or minor blades because respective first ends 141 may be disposed on downhole end 151 a distance from associated bit rotational axis 104. The number and location of primary blades and secondary blades may vary such that drill bit 101 includes more or less primary and secondary blades. Blades 126 may be disposed symmetrically or asymmetrically with regard to each other and bit rotational axis 104 where the disposition may be based on the downhole drilling conditions of the drilling environment. In some cases, blades 126 and drill bit 101 may rotate about rotational axis 104 in a direction defined by directional arrow 105.

Each blade may have a leading (or front) surface 130 disposed on one side of the blade in the direction of rotation of drill bit 101 and a trailing (or back) surface 132 disposed on an opposite side of the blade away from the direction of rotation of drill bit 101. The leading surface 130 may be subject to erosion during the subterranean operation. A localized binder material may be used near the region of leading surfaces 130 of blades 126 to increase the crack-arresting properties, erosion-resistance, and stiffness of leading surfaces 130. Blades 126 may be positioned along bit body 124 such that they have a spiral configuration relative to rotational axis 104. In other configurations, blades 126 may be positioned along bit body 124 in a generally parallel configuration with respect to each other and bit rotational axis 104.

Blades 126 may include one or more cutting elements 128 disposed outwardly from exterior portions of each blade 126. For example, a portion of cutting element 128 may be directly or indirectly coupled to an exterior portion of blade 126 while another portion of cutting element 128 may be projected away from the exterior portion of blade 126. Cutting elements 128 may be any suitable device configured to cut into a formation, including but not limited to, primary cutting elements, back-up cutting elements, secondary cutting elements, or any combination thereof. By way of example and not limitation, cutting elements 128 may be various types of cutters, compacts, buttons, inserts, and gage cutters satisfactory for use with a wide variety of drill bits 101.

Cutting elements 128 may include respective substrates with a layer of hard cutting material, including cutting table 162, disposed on one end of each respective substrate, including substrate 164. Blades 126 may include recesses or cutter pockets 166 that may be configured to receive cutting elements 128. For example, cutter pockets 166 may be concave cutouts on blades 126. Cutter pockets 166 may be subject to impact forces during the subterranean operation. Therefore, a localized binder material may be used to provide impact toughness to cutter pockets 166. Additionally, localized binder material may be used to increase the surface energy of cutter pockets 166 to assist in increasing bonding adhesion. Further, localized binder material may be used to produce rougher surfaces in cutter pockets 166, providing mechanical interlocking during the brazing process when cutting elements 128 are coupled to cutter pockets 166.

Blades 126 may further include one or more gage pads (not expressly shown) disposed on blades 126. A gage pad may be a gage, gage segment, or gage portion disposed on exterior portion of blade 126. Gage pads may often contact adjacent portions of wellbore 114 formed by drill bit 101. Exterior portions of blades 126 and/or associated gage pads may be disposed at various angles, positive, negative, and/or parallel, relative to adjacent portions of generally vertical portions of wellbore 114. A gage pad may include one or more layers of hardfacing material.

Figure 3:
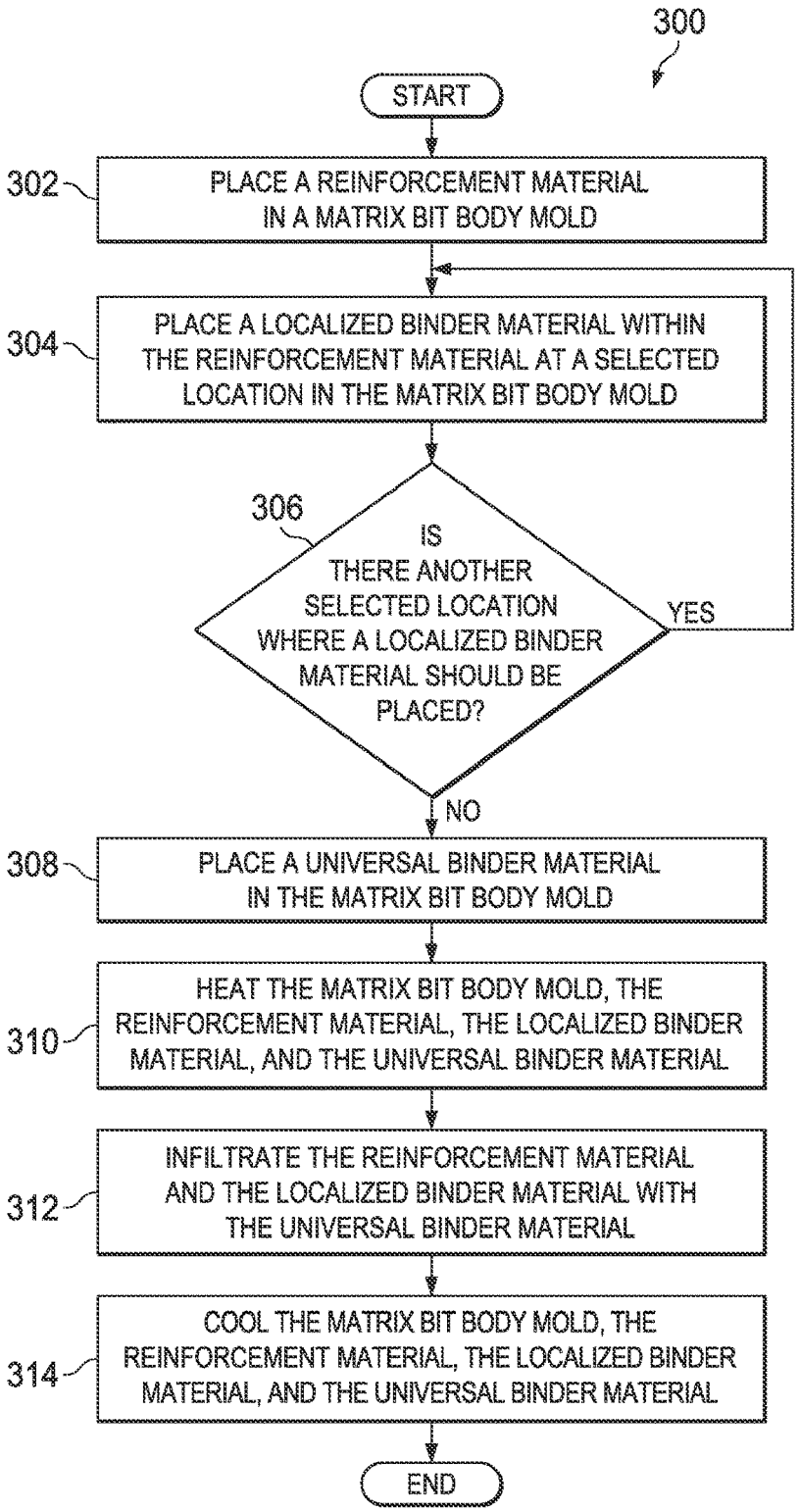
FIG. 3 is a flow chart of an example method of forming an MMC drill bit having localized properties.

Drill bits, such as drill bit 101, may be formed using a mold assembly. FIG. 3 is a flow chart of an example method of forming a metal-matrix composite drill bit having localized properties. The steps of method 300 may be performed by a person or manufacturing device (referred to as a manufacturer) that is configured to fill molds used to form MMC drill bits.

Method 300 may begin at step 302 where the manufacturer may place a reinforcement material in a matrix bit body mold. The matrix bit body mold may be similar to the molds described with respect to FIGS. 4-8. The reinforcement material may be selected to provide designed characteristics for the resulting drill bit, such as fracture resistance, toughness, and/or erosion, abrasion, and wear resistance. The reinforcement material may be any suitable material, such as, but are not limited to, particles of metals, metal alloys, superalloys, intermetallics, borides, carbides, nitrides, oxides, ceramics, diamonds, and the like, or any combination thereof. More particularly, examples of reinforcing particles suitable for use in conjunction with the embodiments described herein may include particles that include, but are not limited to, tungsten, molybdenum, niobium, tantalum, rhenium, iridium, ruthenium, beryllium, titanium, chromium, rhodium, iron, cobalt, nickel, nitrides, silicon nitrides, boron nitrides, cubic boron nitrides, natural diamonds, synthetic diamonds, cemented carbide, spherical carbides, low-alloy sintered materials, cast carbides, silicon carbides, boron carbides, cubic boron carbides, molybdenum carbides, titanium carbides, tantalum carbides, niobium carbides, chromium carbides, vanadium carbides, iron carbides, tungsten carbides, macrocrystalline tungsten carbides, cast tungsten carbides, crushed sintered tungsten carbides, carburized tungsten carbides, steels, stainless steels, austenitic steels, ferritic steels, martensitic steels, precipitation-hardening steels, duplex stainless steels, ceramics, iron alloys, nickel alloys, cobalt alloys, chromium alloys, HASTELLOY® alloys (e.g., nickel-chromium containing alloys, available from Haynes International), INCONEL® alloys (e.g., austenitic nickel-chromium containing superalloys available from Special Metals Corporation), WASPALOYS® (e.g., austenitic nickel-based superalloys), RENE® alloys (e.g., nickel-chromium containing alloys available from Altemp Alloys, Inc.), HAYNES® alloys (e.g., nickel-chromium containing superalloys available from Haynes International), INCOLOY® alloys (e.g., iron-nickel containing superalloys available from Mega Mex), MP98T (e.g., a nickel-copper-chromium superalloy available from SPS Technologies), TMS alloys, CMSX® alloys (e.g., nickel-based superalloys available from C-M Group), cobalt alloy 6B (e.g., cobalt-based superalloy available from HPA), N-155 alloys, any mixture thereof, and any combination thereof. In some embodiments, the reinforcing particles may be coated. In some cases, multiple types of reinforcement material may be used to form a single resulting drill bit.

At step 304, the manufacturer may place a localized binder material within the reinforcement material at a selected location in the matrix bit body mold. The localized binder material may be layered and/or mixed with the reinforcement material. The placement of the localized binder material may provide localized properties in the regions of the resulting drill bit in which the localized binder material is placed, as described in further detail with respect to FIGS. 4-8. The localized binder material may include any suitable binder material such as transition metals (e.g., iridium, rhenium, ruthenium, tungsten, molybdenum, hafnium, chromium, manganese, rhodium, iron, cobalt, titanium, niobium, osmium, palladium, platinum, zirconium, nickel, copper, scandium, tantalum, vanadium, yttrium), post-transition metals (e.g., aluminum and tin), semi-metals (e.g., boron and silicon), alkaline-earth metals (e.g., beryllium and magnesium), lanthanides (e.g., lanthanum and ytterbium), non-metals (e.g., carbon, nitrogen, and oxygen), and/or alloys thereof. The type of localized binder material may be selected based on the diffusion characteristics of the material. For example, some materials may provide a more focused diffusion with less back diffusion which may be more appropriate for use in smaller areas while other materials may provide a faster diffusion and may diffuse over a larger area which may be more appropriate for use in larger areas.

The examples in FIGS. 4-8 illustrate various potential embodiments using different materials for the localized binder material. Using alloys that contain chromium, carbon, molybdenum, manganese, nickel, cobalt, tungsten, niobium, tantalum, vanadium, silicon, copper, and iron for the localized binder material may produce localized properties that may be wear-resistant, erosion-resistant, abrasion-resistant, or hard. Using iridium, rhenium, ruthenium, tungsten, molybdenum, beryllium, chromium, rhodium, iron, cobalt, nickel, and alloys thereof for the localized binder material may produce stiff localized properties. For example, alloying nickel with vanadium, chromium, molybdenum, tantalum, tungsten, rhenium, osmium, or iridium increases the elastic modulus of the resulting alloy.

The formation of ceramic materials (e.g., carbides, borides, nitrides, and oxides) due to the interaction of the localized binder material and the universal binder material may produce beneficial localized changes in any of the desired properties mentioned previously. As an example, ceramic materials, which typically have high surface energies with many metals, may be beneficial in the junk slots, where anti-balling properties are desired. The in-situ formation of carbides, borides, nitrides, and oxides may be achieved by including carbon, boron, nitrogen, and oxygen in the localized binder material. In particular, carbides may be formed by using molybdenum, tungsten, chromium, titanium, niobium, vanadium, tantalum, zirconium, hafnium, manganese, iron, nickel, boron, and silicon in the localized binder material. Borides may be formed by using titanium, zirconium, hafnium, vanadium, niobium, tantalum, chromium, molybdenum, tungsten, iron, cobalt, nickel, and lanthanum in the localized binder material. Nitrides may be formed by using boron, silicon, aluminum, iron, nickel, scandium, yttrium, titanium, vanadium, chromium, zirconium, molybdenum, tungsten, tantalum, hafnium, manganese, and niobium in the localized binder material. Oxides may be formed by using silicon, aluminum, yttrium, zirconium, and titanium in the localized binder material.

Intermetallics may also prove beneficial since the formation of such materials in the area near the localized binder material may produce beneficial changes in any of the desired properties mentioned previously. Suitable intermetallics include both stoichiometric and non-stoichiometric phases that are formed between two metallic elements. Examples of elements that form refractory aluminum-based intermetallics include boron, carbon, cobalt, chromium, copper, iron, hafnium, iridium, manganese, molybdenum, niobium, nickel, palladium, platinum, rhenium, ruthenium, scandium, tantalum, titanium, vanadium, tungsten, and zirconium. Other examples of refractory intermetallic systems include silver-titanium, silver-zirconium, gold-hafnium, gold-manganese, gold-niobium, gold-scandium, gold-tantalum, gold-titanium, gold-thulium, gold-vanadium, gold-zirconium, boron-chromium, boron-manganese, boron-molybdenum, boron-niobium, boron-neodymium, boron-ruthenium, boron-silicon, boron-titanium, boron-vanadium, boron-tungsten, boron-yttrium, beryllium-copper, beryllium-iron, beryllium-niobium, beryllium-nickel, beryllium-palladium, beryllium-titanium, beryllium-vanadium, beryllium-tungsten, beryllium-zirconium, any combination thereof, and the like.

In some cases, the localized binder material may include and may otherwise be reinforced with reinforcing particles, such as the reinforcing particles mentioned above with reference to the reinforcing materials.

The localized binder material may have various sizes and shapes according to the selected localized properties and/or the selected diffusion rates of localized binder material, as described in further detail with respect to FIGS. 4-8. The localized binder material may be placed in a variety of configurations, based on the selected properties and/or the size of the region over which the localized properties are to be spread. Examples of different configurations for localized binder material are shown in FIGS. 4-8.

At step 306, the manufacturer may determine whether there is another selected location where a localized binder material should be placed. If there is another selected location where a localized binder material should be placed, method 300 may return to step 304 and place localized binder material in the next selected location, otherwise method 300 may proceed to step 308. Steps 302 and 304 may occur simultaneously until the matrix bit body mold has been filled.

At step 308, the manufacturer may place a universal binder material in the matrix bit body mold. The universal binder material may be placed in the mold after the reinforcement material has been packed into the mold. The universal binder material may include any suitable binder material such as copper, nickel, cobalt, iron, aluminum, molybdenum, chromium, manganese, tin, zinc, lead, silicon, tungsten, boron, phosphorous, gold, silver, palladium, indium, and/or alloys thereof. The universal binder material and/or the localized binder material may be selected such that the downhole temperatures during the subterranean operation are less than the melting point of the universal binder material, the localized binder material, and/or any alloy formed between the universal binder material and the localized binder material.

At step 310, the manufacturer may heat the matrix bit body mold and the materials disposed therein via any suitable heating mechanism, including a furnace. When the temperature of the universal binder material exceeds the melting point of the universal binder material, the liquid universal binder material may flow into the reinforcement material.

At step 312, as the universal binder material infiltrates the reinforcement material, the universal binder material may additionally react with and/or diffuse into the localized binder material. In some reactions, the reaction between the universal binder material and the localized binder material may form an intermetallic material composition. In other reactions, the reaction between the universal binder material and the localized binder material may form a stiff alloy composition.

At step 314, the manufacturer may cool the matrix bit body mold, the reinforcement material, the localized binder material, and the universal binder material. The cooling may occur at a controlled rate. After the cooling process is complete, the mold may be broken away to expose the body of the resulting drill bit. The resulting drill bit body may be subjected to further manufacturing processes to complete the drill bit.

Figure 4:
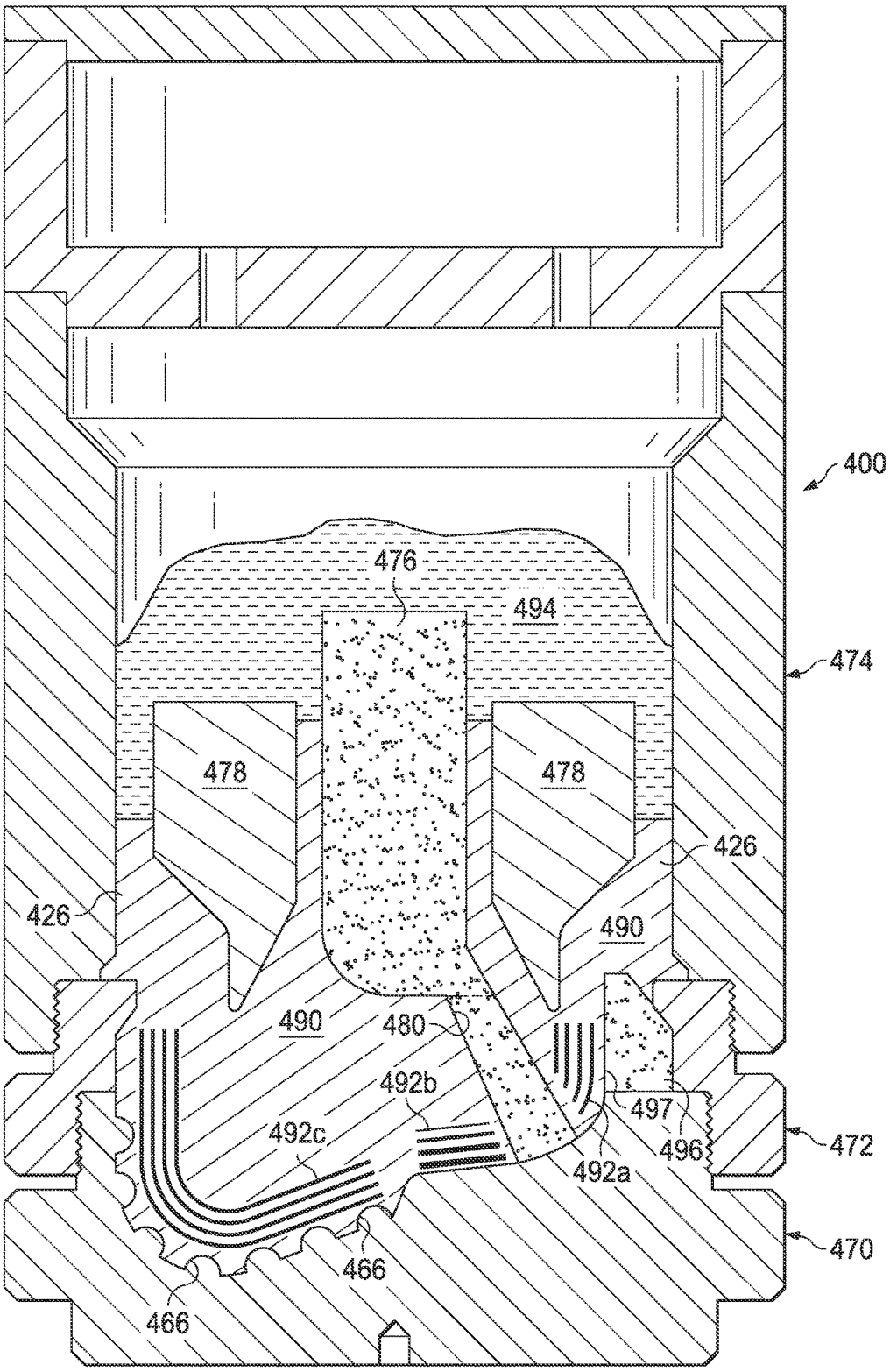
FIG. 4 is a schematic drawing in section with portions broken away showing an example of a mold assembly with foils and sheets of a localized binder material positioned near an outer surface of a blade and an apex of a metal-matrix composite (MMC) drill bit.

FIG. 4 is a schematic drawing in section with portions broken away showing an example of a mold assembly with foils and sheets of a localized binder material positioned near an outer surface of a blade and an apex of an MMC drill bit. Mold assembly 400 may include mold 470, gauge ring 472, and funnel 474 which may be formed of any suitable material, such as graphite. Gauge ring 472 may be threaded to couple with the top of mold 470 and funnel 474 may be threaded to couple with the top of gauge ring 472. Funnel 474 may be used to extend mold assembly 400 to a height based on the size of the drill bit to be manufactured using mold assembly 400. The components of mold assembly 400 may be created using any suitable manufacturing process, such as casting and/or machining. The shape of mold assembly 400 may have a reverse profile from the exterior features of the drill bit to be formed using mold assembly 400 (the resulting drill bit).

In some cases, various types of temporary displacement materials and/or mold inserts may be installed within mold assembly 400, depending on the configuration of the resulting drill bit. The temporary displacement materials and/or mold inserts may be formed from any suitable material, such as consolidated sand and/or graphite. The temporary displacement materials and/or mold inserts may be used to form voids in the resulting drill bit. For example, consolidated sand may be used to form core 476 and/or fluid flow passage 480. Additionally, mold inserts (not expressly shown) may be placed within mold assembly 400 to form pockets 466 in blade 426. Cutting elements, including cutting elements 128 shown in FIG. 2, may be attached to pockets 466, as described with respect to cutter pockets 166 in FIG. 2.

A generally hollow, cylindrical metal mandrel 478 may be placed within mold assembly 400. The inner diameter of metal mandrel 478 may be larger than the outer diameter of core 476 and the outer diameter of metal mandrel 478 may be smaller than the outer diameter of the resulting drill bit. Metal mandrel 478 may be used to form a portion of the interior of the drill bit.

After displacement materials are placed within mold assembly 400, mold assembly may be filled with reinforcement material 490. Reinforcement material 490 may be selected to provide designed characteristics for the resulting drill bit, such as fracture resistance, toughness, and/or erosion, abrasion, and wear resistance. Reinforcement material 490 may be any suitable material, such as particles of metals, metal alloys, superalloys, intermetallics, borides, carbides, nitrides, oxides, ceramics, diamonds, and the like, or any combination thereof. While a single type of reinforcement material 490 is shown in FIG. 4, multiple types of reinforcement material 490 may be used.

During the process of loading reinforcement material 490 in mold assembly 400, localized binder material 492 may be loaded in specific locations and may be layered and/or mixed with reinforcement material 490, as described instep 304 of method 300 shown in FIG. 3. The placement of localized binder material 492 may provide localized properties in the regions of the resulting drill bit in which localized binder material 492 is placed. Localized binder material 492 may include any suitable binder material such as a material selected from the group consisting of a transition metal, a post-transition metal, a semi-metal, an alkaline-earth metal, a lanthanide, a non-metal, and any alloy thereof. Localized binder material 492 may be selected based on the diffusion characteristics of the material. For example, some materials may provide a more focused diffusion with less back diffusion which may be more appropriate for use in smaller areas, including pockets 466, while other materials may provide a faster diffusion and may diffuse over a larger area which may be more appropriate for use in larger areas, including the outer surface of blade 426. A more focused reaction between universal binder material 494 and localized binder material 492 may be achieved by selecting materials with low interdiffusion coefficients and relying upon gravity and alloying of the materials during the infiltration process to produce localized properties in the localized regions.

Localized binder material 492 may have various sizes and shapes according to the selected localized properties and/or the selected diffusion rates of localized binder material 492. For example, localized binder material 492 may have a geometric shape, including a cube, sphere, star, ring, rectangular prism, and/or parallelpiped shape, or may be in foils or plates. In some cases, localized binder material 492 may be in a powdered form and may be mixed with reinforcement material 490 and placed in the selected areas. In a powdered form, localized binder material 492 may have a size ranging from a micron scale to a millimeter scale.

Localized binder material 492 may be placed in a variety of configurations, based on the selected properties and/or the size of the region over which the localized properties are to be spread. For example, in FIG. 4, localized binder material 492*a* may be plates and/or foils of substantially the same thickness placed near outer surface 497 of junk slot displacement 496 and localized binder material 492*b* may be plates and/or foils of various thicknesses placed in the landing area of the resulting drill bit. In addition, localized binder material 492*c* may be plates and/or foils of substantially the same thickness placed near the outer surface of blade 426. The thickness gradient of localized binder material 492*b* may provide graduated properties throughout the apex region of blade 426. In some configurations, localized binder material 492 may be shaped to conform to the local geometry of the resulting drill bit. For example, localized binder material 492*a* may be curved similar to the curvature of junk slot displacement 496.

Once reinforcement material 490 and localized binder material 492 are loaded in mold assembly 400, reinforcement material 490 may be packed into mold assembly 400 using any suitable mechanism, such as a series of vibration cycles. The packing process may help to ensure consistent density of reinforcement material 490 and provide consistent properties throughout the portions of the resulting drill bit formed of reinforcement material 490.

After the packing of reinforcement material 490, universal binder material 494 may be placed on top of reinforcement material 490, core 476, and/or metal mandrel 478. Universal binder material 494 may include any suitable binder material such as copper, nickel, cobalt, iron, aluminum, molybdenum, chromium, manganese, tin, zinc, lead, silicon, tungsten, boron, phosphorous, gold, silver, palladium, indium, and/or alloys thereof. Universal binder material 494 and/or localized binder material 492 may be selected such that the downhole temperatures during the subterranean operation are less than the critical temperature or melting point of universal binder material 494, localized binder material 492, and/or any alloy formed between universal binder material 494 and localized binder material 492.

Mold assembly 400 and the materials disposed therein may be heated via any suitable heating mechanism, including a furnace. When the temperature of universal binder material 494 exceeds the melting point of universal binder material 494, liquid universal binder material 494 may flow into reinforcement material 490 towards mold 470. As universal binder material 494 infiltrates reinforcement material 490, universal binder material 494 may additionally react with and/or diffuse into localized binder material 492. In some reactions, the reaction between universal binder material 494 and localized binder material 492 may form an intermetallic material composition. In other reactions, the reaction between universal binder material 494 and localized binder material 492 may form a stiff alloy composition. The diffusion between universal binder material 494 and localized binder material 492 may form a functional gradient of properties between the regions of the drill bit containing infiltrated reinforcement material 490 and regions of the bit containing fused localized binder material 492.

Once universal binder material 494 has infiltrated reinforcement material 490 and/or localized binder material 492, mold assembly 400 may be removed from the furnace and cooled at a controlled rate. After the cooling process is complete, mold assembly 400 may be broken away to expose the body of the resulting drill bit. The resulting drill bit body may be subjected to further manufacturing processes to complete the drill bit. For example, cutting elements (for example, cutting elements 128 shown in FIG. 2) may be brazed to the drill bit to couple the cutting elements to pockets 466. During the brazing process, localized binder material 492, universal binder material 494, and/or any alloy formed between universal binder material 494 and localized binder material 492 may be heated above their melting points and some additional local diffusion may occur where any localized binder material 492 located near pockets 466 may additionally diffuse with reinforcement material 490 and/or universal binder material 494.

Figure 5:
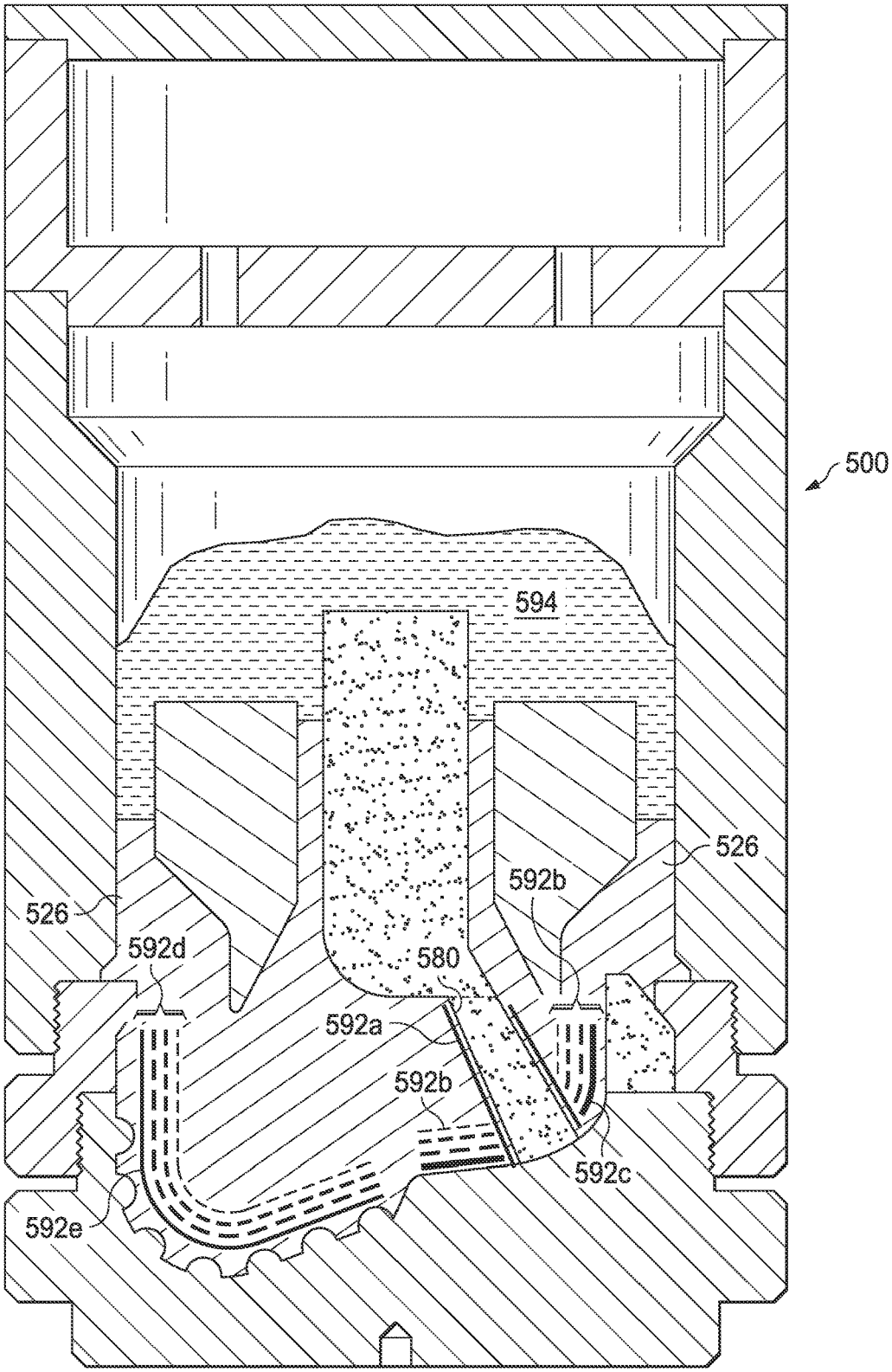
FIG. 5 is a schematic drawing in section with portions broken away showing an example of a mold assembly with foils and meshes of a localized binder material positioned near a fluid flow passage, an outer surface of a blade, and an apex of an MMC drill bit.

FIG. 5 is a schematic drawing in section with portions broken away showing an example of a mold assembly with foils and meshes of a localized binder material positioned around a fluid flow passage of an MMC drill bit. FIG. 5 illustrates another example configuration for placing localized binder material 592 in mold assembly 500. Mold assembly 500, the components thereof and materials disposed therein may be similar to mold assembly 400, the components thereof, and materials disposed therein, as described in FIG. 4. Localized binder material 592*a* may be a foil wrap or cylinder of localized binder material 592 placed around fluid flow passage 580. Localized binder material 592*a* may be selected to provide localized properties near fluid flow passage 580. For example, localized binder material 592*a*, after a reaction and/or diffusion with universal binder material 594, may provide enhanced stiffness and erosion resistance and reduce the surface energy in fluid flow passage 580.

Localized binder material 592*b* may be a foil wrap in a mesh configuration placed near the junk-slot surface and landing area of the resulting drill bit. The size of the openings in the mesh of localized binder material 592*b* may provide functional grading of the properties provided by localized binder material 592*b*. Further, localized binder material 592*d* may be a foil wrap in a mesh configuration placed near the outer surface and apex region of blade 526. For example, in FIG. 5, the mesh opening size may be reduced in the foil layers of localized binder material 592*b* that are closer to the surface of blade 526. Localized binder material 592*b* and 592*d* in a mesh, grate, or screen configuration may be used in conjunction with localized binder material 592*c* and 592*e* in a solid foil and/or plate configuration.

Figure 6:
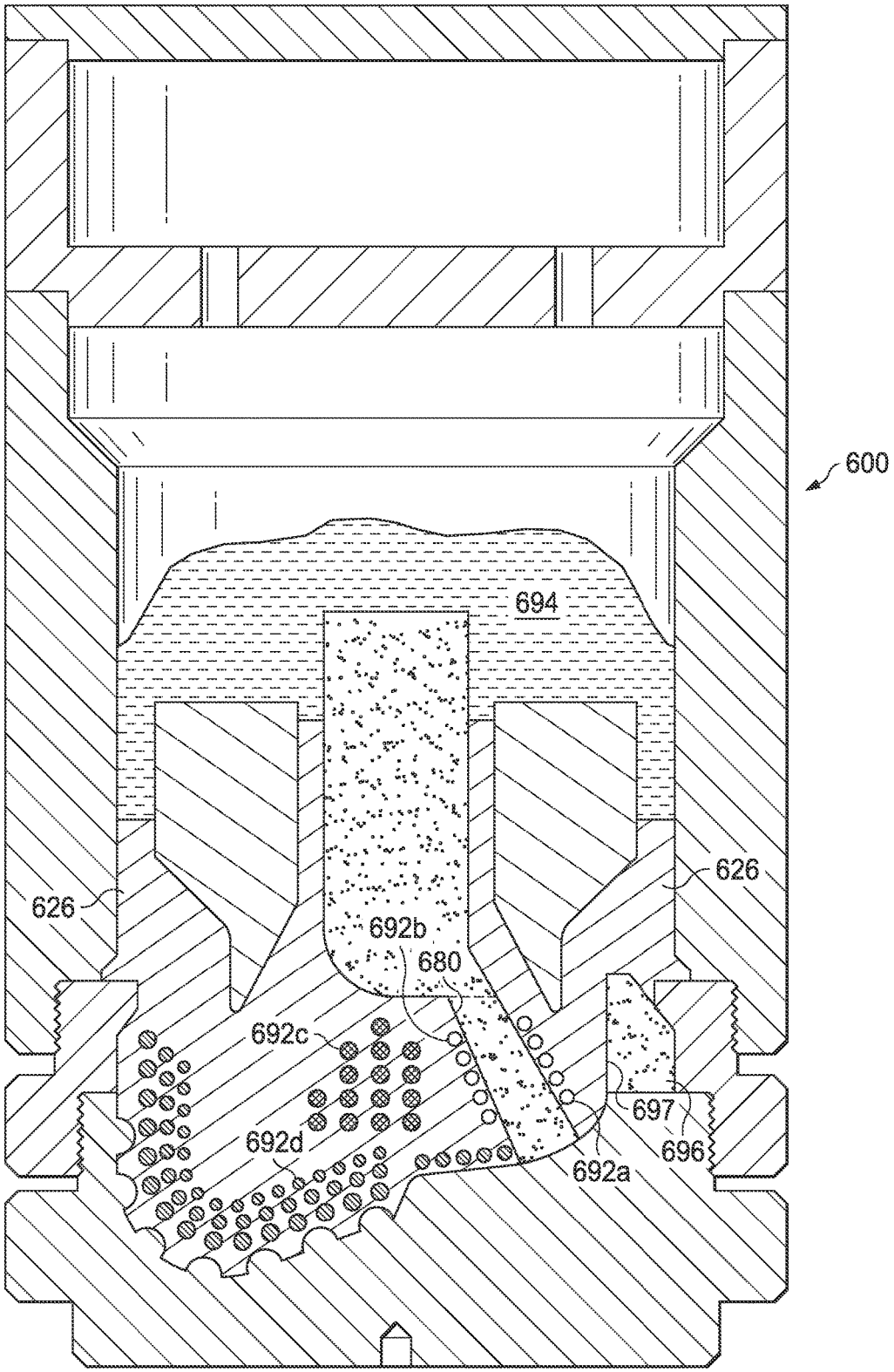
FIG. 6 is a schematic drawing in section with portions broken away showing an example of a mold assembly with rings, rods, and pellets of a localized binder material positioned near a fluid flow passage, an outer surface of a blade, and an apex of an MMC drill bit.

FIG. 6 is a schematic drawing in section with portions broken away showing an example of a mold assembly with rings, rods, and pellets of a localized binder material positioned near a fluid flow passage, near an outer surface, and in the interior of an MMC drill bit. Mold assembly 600, the components thereof and materials disposed therein may be similar to mold assembly 400, the components thereof, and materials disposed therein, as described in FIG. 4. FIG. 6 illustrates localized binder material 692 in a spherical, ring, arc length, or curved rod configuration. For example, localized binder material 692*a* may be rings of localized binder material placed around fluid flow passage 680, localized binder material 692*b* may be curved rods that span the width of the junk slot, localized binder material 692*c* may be spherical pellets placed in the interior cone region of the resulting drill bit body, and localized binder material 692*d* may be curved rods that span the width of blade 626.

Localized binder materials 692*a*-692*d* may be different materials that may result in different properties in the regions of the resulting drill bit body in which localized binder material 692 is placed. For example, localized binder material 692*a* and 692*b* may be a material selected to provide stiffness, erosion resistance, and modified surface energy for fluid flow passage 680 and/or surface 697 of junk slot displacement 696. The composition formed by universal binder material 694 and localized binder material 692*a* and 692*b* may have a smooth surface finish that may enhance the flow of fluid through fluid flow passage 680. Localized binder material 692*d* may be a material selected to provide stiffness and erosion resistance on the outer surface and apex regions of blade 526 where the drill bit is exposed to harsh conditions during a subterranean operation. Localized binder material 692*c* may be a material selected to provide fracture resistance and prevent crack propagation in the cone of the resulting drill bit.

Figure 7:
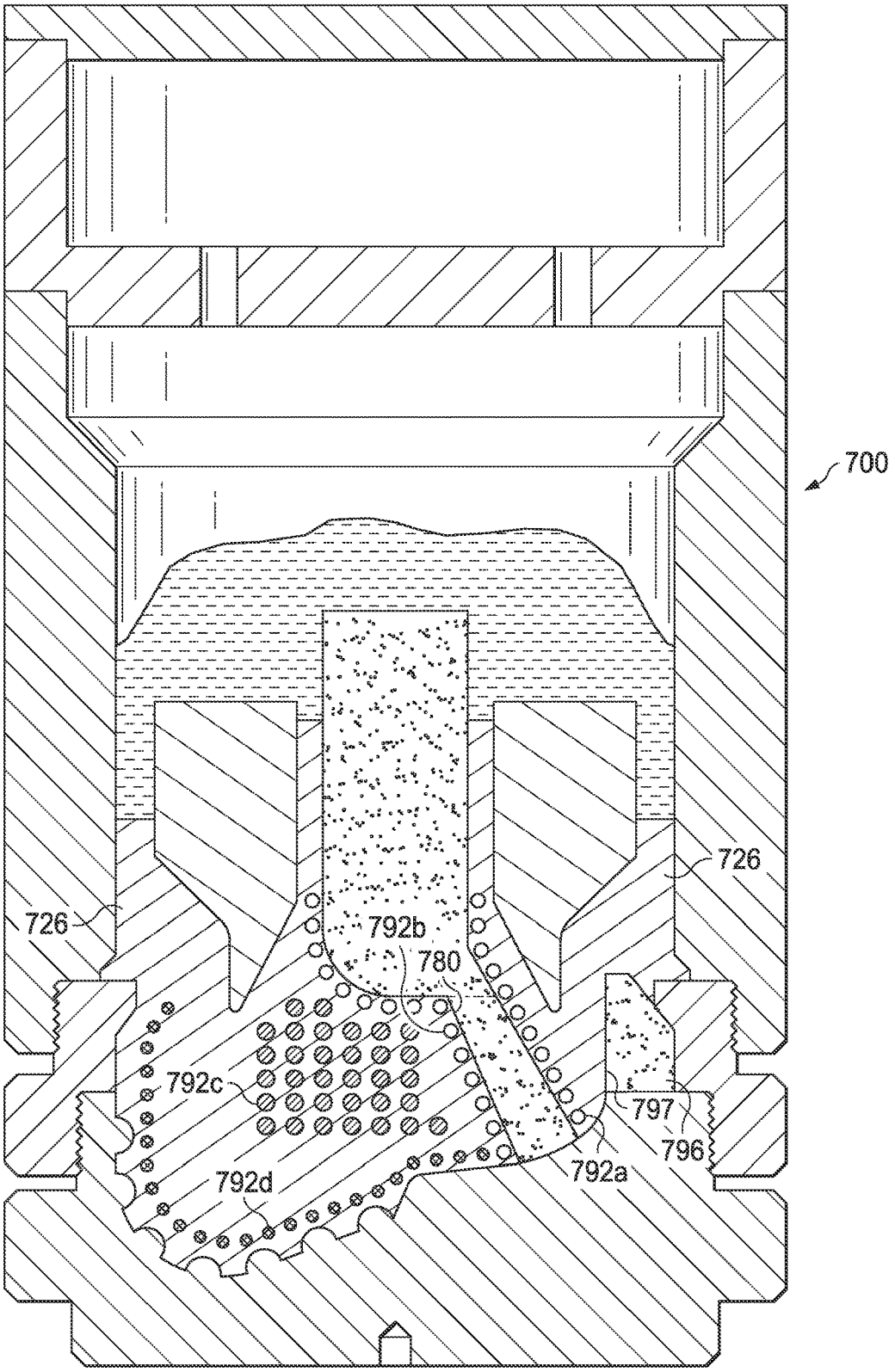
FIG. 7 is a schematic drawing in section with portions broken away showing an example of a mold assembly with rings, rods, and pellets of a localized binder material positioned near a fluid flow passage, an outer portion of a blade, and an apex of an MMC drill bit.

FIG. 7 is a schematic drawing in section with portions broken away showing an example of a mold assembly with rings, rods, and pellets of a localized binder material positioned near an outer portion of a blade, near a fluid flow passage, and in the interior of an MMC drill bit. Mold assembly 700, the components thereof and materials disposed therein may be similar to mold assembly 400, the components thereof, and materials disposed therein, as described in FIG. 4. FIG. 7 illustrates a localized binder material 792 placement similar to the placement of localized binder material 692 shown in FIG. 6. However, in FIG. 7, localized binder material 792*a* and 792*b* spans the entire length of fluid flow passage 780 in addition to the bottom portion of the central flow passage and surface 797 of junk slot displacement 796. As described with reference to FIG. 6, localized binder material 792*a* may be a material selected to provide a smooth surface finish and may allow a high pressure flow of fluid through fluid flow passage 780.

Localized binder material 792*d* may span a relatively large region of blade 726 where some materials of blade 726 may be machined away during manufacturing of the resulting drill bit body. Localized binder material 792*d* may provide localized stiffness for blade 726 to prevent cracks during the machining process. Localized binder material 792*c* may be located in a large portion of the center of the bit and blade 726 in a region where the resulting drill bit body is not likely to experience wear. Localized binder material 792*c* may displace some reinforcement material 690 and may be a less expensive material than matrix reinforcement material 690 and thus the use of localized binder material 792*c* may reduce the cost of manufacturing the resulting drill bit body.

Figure 8:
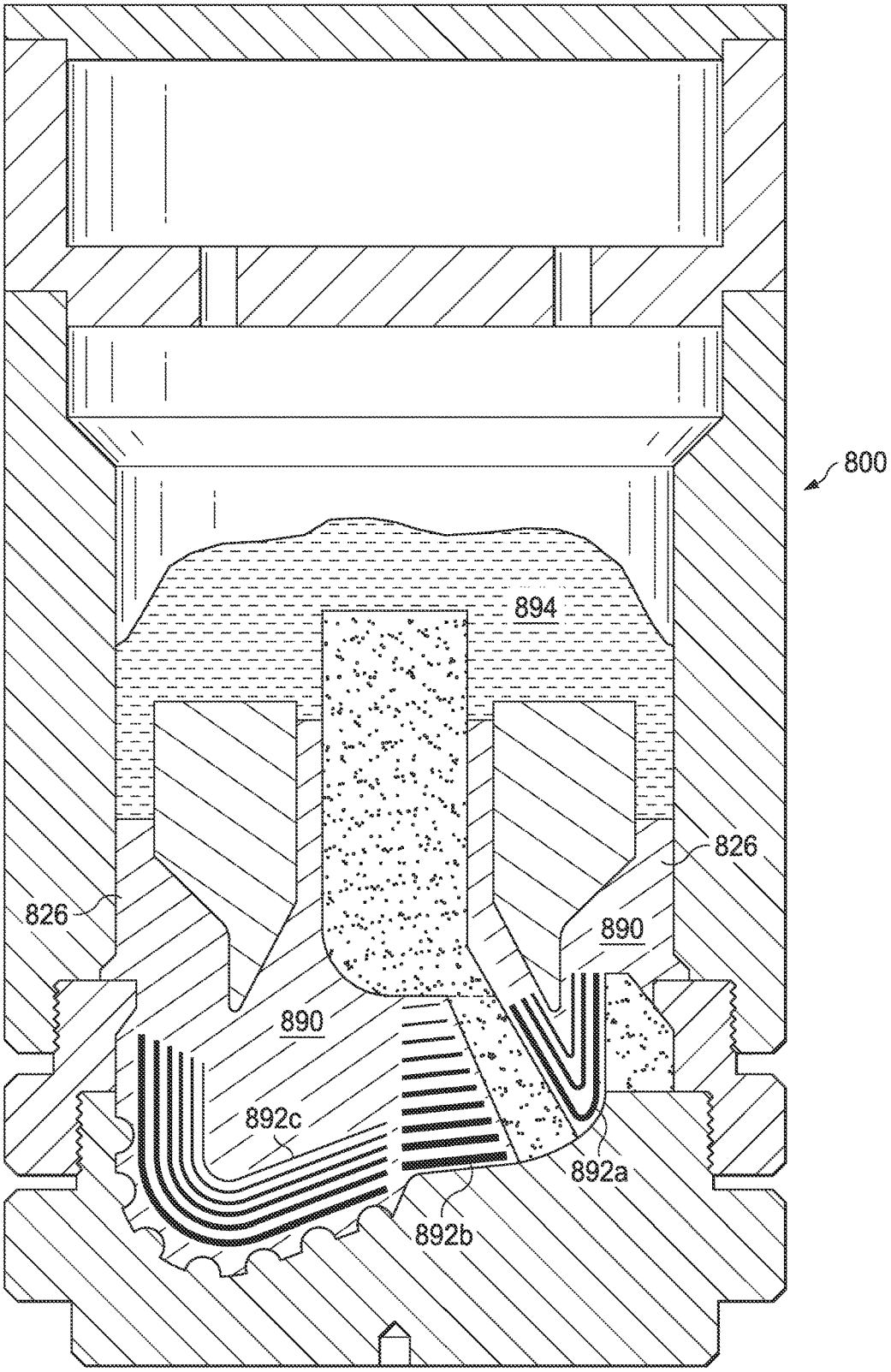
FIG. 8 is a schematic drawing in section with portions broken away showing an example of a mold assembly with plates and foils of a localized binder material positioned in a graduated configuration near a fluid flow passage, an outer surface of a blade, and an apex of an MMC drill bit.

FIG. 8 is a schematic drawing in section with portions broken away showing an example of a mold assembly with plates and foils of a localized binder material positioned in a graduated configuration near an outer surface of a blade and a fluid flow passage of an MMC drill bit. Mold assembly 800, the components thereof and materials disposed therein may be similar to mold assembly 400, the components thereof, and materials disposed therein, as described in FIG. 4. In FIG. 8, localized binder material 892*a-c* is placed in mold assembly 800 in a configuration where the thickness of the foils and/or plates generally varies in thickness from thinner near the center of blade 826 to thicker near the exterior of blade 826. The configuration of localized binder material 892*a-c* may provide a gradient of the properties throughout blade 826 such that the properties in the center of blade 826 are similar to the properties of a composition made of reinforcement material 890 and universal binder material 894 and the properties of the exterior of blade 826 are similar to the properties of a composition formed of reinforcement material 890, universal binder material 894, and localized binder material 892. While the gradient of localized binder material 892*a-c* is shown in FIG. 8 as having the largest proportion of localized binder material 892*a-c* near the surface of blade 826, the gradient may be reversed where the largest proportion of localized binder material 892*a-c* is near the center of blade 826.

The localized binder material configurations shown in FIGS. 4-8 are exemplary only. Any number of localized binder material configurations are anticipated by the present disclosure. The type, shape, and size of the localized binder material may be based on the properties selected for the region of the drill bit in which the localized binder material is placed. Additionally the spacing between individual pieces of localized binder material may vary based on the type, shape, and/or size of localized binder material used, the diffusion rates of the localized binder material, and the properties selected for the region of the drill bit in which the localized binder material is placed.

Modeling of an MMC drill bit and/or simulation of a subterranean operation may be used to obtain an analysis of the stresses to which the MMC drill bit may be subjected during the subterranean operation. The stress analysis may be used to select the type of localized binder material used in the MMC drill bit, the size, shape, and/or spacing of the localized binder material, and/or the placement of the localized binder material.

Embodiments disclosed herein include:

A. A drill bit including a body, a plurality of blades on the body, a plurality of cutting elements on at least one of the plurality of blades, a reinforcement material forming portions of the body and the plurality of blades, a localized binder material placed within the reinforcement material at selected locations, wherein the localized binder material confers a selected physical property at the selected location, and a universal binder material infiltrated through the reinforcement material and the localized binder material.

B. A method of making a matrix drill bit including placing a reinforcement material in a matrix bit body mold, placing a localized binder material within the reinforcement material at a selected location in the matrix bit body mold, wherein the localized binder material confers a selected physical property at the selected location, placing a universal binder material in the matrix bit body mold on top of the reinforcement material, heating the matrix bit body mold, the reinforcement material, the localized binder material, and the universal binder material to a temperature above the melting point of the universal binder material, infiltrating the reinforcement material and the localized binder material with the universal binder material, and cooling the matrix bit body mold, the reinforcement material, the localized binder material, and the universal binder material to form a matrix drill bit body.

C. A drilling system including a drill string and a drilling tool coupled to the drill string. The drilling tool includes a body, a plurality of blades on the body, a plurality of cutting elements on at least one of the plurality of blades, a reinforcement material forming portions of the body and the plurality of blades, a localized binder material placed within the reinforcement material at selected locations, wherein the localized binder material confers a selected physical property at the selected location, and a universal binder material infiltrated through the reinforcement material and the localized binder material.

Each of embodiments A, B, and C may have one or more of the following additional elements in any combination: Element 1: wherein the localized binder material has a shape of at least one of: a foil, a sheet, a pellet, a ring, a sphere, a cylinder, a mesh, a grate, a screen, an arc length, and a curved rod. Element 2: wherein the localized binder material increases a crack-arresting property at the selected location. Element 3: wherein the localized binder material increases an impact toughness at the selected location. Element 4: wherein the localized binder material increases an erosion-resistant property at the selected location. Element 5: wherein the localized binder material modifies a surface-energy property at the selected location. Element 6: wherein the localized binder material is a different material from the universal binder material. Element 7: wherein the localized binder material and the universal binder material react to form at least one of an intermetallic composition, a ceramic composition, a ductile alloy composition, a stiff alloy composition, and a precipitation hardened or hardenable alloy composition. Element 8: wherein the localized binder material is placed within the reinforcement material in a gradient configuration.

Although the present disclosure and its advantages have been described in detail, it should be understood that various changes, substitutions and alterations can be made herein without departing from the spirit and scope of the disclosure as defined by the following claims. It is intended that the present disclosure encompasses such changes and modifications as fall within the scope of the appended claims.

What is claimed is:

1. A drill bit comprising:
- a body;
- a plurality of blades on the body;
- a plurality of cutting elements on at least one of the plurality of blades;
- a reinforcement material forming portions of the body and the plurality of blades;
- a localized binder material placed within the reinforcement material at selected locations, wherein the localized binder material confers a selected physical property at the selected location; and
- a universal binder material infiltrated through the reinforcement material and the localized binder material.

2. The drill bit of claim 1, wherein the localized binder material has a shape of at least one of: a foil, a sheet, a pellet, a ring, a sphere, a cylinder, a mesh, a grate, a screen, an arc length, a curved rod, a cube, a rectangular prism, and a parallelpiped.

3. The drill bit of claim 1, wherein the localized binder material increases a crack-arresting property at the selected location.

4. The drill bit of claim 1, wherein the localized binder material increases an impact toughness at the selected location.

5. The drill bit of claim 1, wherein the localized binder material increases an erosion-resistant property at the selected location.

6. The drill bit of claim 1, wherein the localized binder material modifies a surface-energy property at the selected location.

7. The drill bit of claim 1, wherein the localized binder material is a different material from the universal binder material.

8. The drill bit of claim 1, wherein the localized binder material and the universal binder material react to form at least one of an intermetallic composition, a ceramic composition, a ductile alloy composition, a stiff alloy composition, and a precipitation hardened or hardenable alloy composition.

9. The drill bit of claim 1, wherein the localized binder material is placed within the reinforcement material in a gradient configuration.

10. A method of making a matrix drill bit comprising:
- placing a reinforcement material in a matrix bit body mold;
- placing a localized binder material within the reinforcement material at a selected location in the matrix bit body mold, wherein the localized binder material confers a selected physical property at the selected location;
- placing a universal binder material in the matrix bit body mold on top of the reinforcement material;
- heating the matrix bit body mold, the reinforcement material, the localized binder material, and the universal binder material to a temperature above the melting point of the universal binder material;
- infiltrating the reinforcement material and the localized binder material with the universal binder material; and
- cooling the matrix bit body mold, the reinforcement material, the localized binder material, and the universal binder material to form a matrix drill bit body.

11. The method of claim 10, wherein the localized binder material has a shape of at least one of: a foil, a sheet, a pellet, a ring, a sphere, a cylinder, a mesh, a grate, a screen, an arc length, a curved rod, a cube, a rectangular prism, and a parallelpiped.

12. The method of claim 10, wherein the localized binder material is a different material from the universal binder material.

13. The method of claim 10, wherein the localized binder material and the universal binder material react to form at least one of an intermetallic composition, a ceramic composition, a ductile alloy composition, a stiff alloy composition, and a precipitation hardened or hardenable alloy composition.

14. The method of claim 10, wherein placing the localized binder material within the reinforcement material at the selected location in the matrix bit body mold includes placing the localized binder material within the reinforcement material in a gradient configuration.

15. The method of claim 10, wherein the localized binder material modifies at least one of a crack-arresting property at the selected location, an impact toughness at the selected location, an erosion-resistant property at the selected location, and a surface-energy property at the selected location.

16. A drilling system, comprising:
- a drill string; and
- a drilling tool coupled to the drill string, the drilling tool comprising:
  - a body;
  - a plurality of blades on the body;
  - a plurality of cutting elements on at least one of the plurality of blades;
  - a reinforcement material forming portions of the body and the plurality of blades;
  - a localized binder material placed within the reinforcement material at selected locations, wherein the localized binder material confers a selected physical property at the selected location; and a universal binder material infiltrated through the reinforcement material and the localized binder material.

17. The drilling system of claim 16, wherein the localized binder material has a shape of at least one of: a foil, a sheet, a pellet, a ring, a sphere, a cylinder, a mesh, a grate, a screen, an arc length, a curved rod, a cube, a rectangular prism, and a parallelpiped.

18. The drilling system of claim 16, wherein the localized binder material is a different material from the universal binder material.

19. The drilling system of claim 16, wherein the localized binder material and the universal binder material react to form at least one of an intermetallic composition, a ceramic composition, a ductile alloy composition, a stiff alloy composition, and a precipitation hardened or hardenable alloy composition.

20. The drilling system of claim 16, wherein the localized binder material is placed within the reinforcement material in a gradient configuration.

* * * * *